US005377068A

United States Patent [19]

Kaylor et al.

[11] Patent Number: 5,377,068

[45] Date of Patent: Dec. 27, 1994

[54] ELECTROMAGNET WITH HOLDING CONTROL

[75] Inventors: Stephen Kaylor; Gordon Yowell, both of Boca Raton, Fla.

[73] Assignee: Predator Systems Inc., Boca Baton, Fla.

[21] Appl. No.: 962,852

[22] Filed: Oct. 19, 1992

[51] Int. Cl.[5] ..... H01H 47/04

[52] U.S. Cl. ..... 361/154; 361/210

[58] Field of Search ..... 361/139, 143, 152, 153, 361/154, 155, 156, 160, 166, 210

[56] References Cited

U.S. PATENT DOCUMENTS

| | | | |
|---|---|---|---|
| 2,970,246 | 1/1961 | Gunkel | 361/154 |
| 3,449,639 | 6/1969 | Brown et al. | 361/154 |
| 3,568,008 | 3/1971 | Tanimura | 361/155 |
| 4,114,184 | 9/1978 | Stampfli | 361/154 |
| 4,609,965 | 9/1986 | Baker | 361/160 |

*Primary Examiner*—Jeffrey A. Gaffin
*Attorney, Agent, or Firm*—Alvin S. Blum

[57] ABSTRACT

A control system for an electromagnetic device prevents overheating of the coils to permit optimizing design parameters without the need for excessive safety factors. A pull coil circuit feeds a high current to pull windings for a preset time interval after receipt of an initiating voltage. A hold coil circuit feeds a holding current to holding windings with a reduced flux after receipt of an initiating voltage only if it exceeds a preset voltage threshold. The hold current is cut off when the initiating voltage falls below a preset threshold. The pull coil circuit is rendered inoperative for a preset time interval after current is discontinued to ensure adequate cooling between operations.

19 Claims, 2 Drawing Sheets

ELECTROMAGNET WITH HOLDING CONTROL

BACKGROUND OF THE INVENTION

The present invention relates generally to electromagnetic devices such as solenoids, relays, clutches and the like and more particularly to control circuits for these devices which regulate the application of electric current thereto.

Electromagnetic devices such as solenoids often require considerably greater magnetic flux during the initial actuation or pull phase when the armature is moved from a first, rest position to a second, actuated position and they require considerably less flux to hold the armature in the second, actuated position. A coil and current optimized for the pull phase is not suitable for the hold phase. It will overheat and waste power. Various inventions of the prior art are directed to the problem. Some employ two different coils, a pull coil and a hold coil. Power is first applied to the pull coil alone or with the hold coil. When the armature has moved, the pull coil is deactivated and power is applied, or continued to be applied, to the hold coil. Switching may be accomplished through mechanical action of the armature on a switch, or a timed initial power pulse may be applied to the pull coil while continuous power is applied to the hold coil. When applied to a single coil electromagnet an initial timed pull pulse may be superimposed on a continuous hold voltage.

If the pull coil is optimized for a particular size and duration of voltage pulse, it will have just the amount of metal in the wire coil to carry the necessary current to provide the necessary flux with just enough insulation to permit correct winding and heat dissipation.

If the device is energized again before the coil has cooled down from the prior operation, it may burn out. To overcome this problem, the coil is made with a safety factor, but is now no longer optimized for its intended function. It may be larger, heavier and more expensive. Furthermore, small line voltage fluctuations may actuate the circuit and heat up the coil. The designer must make a compromise between reliability and optimum operation. Since replacement of a burned out coil may be very expensive in time, money and reputation, most instruments are manufactured with solenoids that are not optimized for their intended function.

SUMMARY OF THE INVENTION

It is accordingly an object of the invention to provide electric power circuitry to one ore more electromagnet coils that will ensure that only the correct amount of electric power is applied in a timely fashion as is necessary for operation so as to permit optimum coil design.

The electromagnet power circuitry of the invention includes a voltage controlled electronic switch which applies current to a holding coil only when a threshold input voltage is reached or exceeded. The switch cuts off current to the hold coil when input voltage drops below a preset voltage.

A time controlled electronic switch applies current to a pull coil only when a threshold input voltage is reached. The pull current is applied for a preset first time interval after which it shuts off. The pull current will then remain off and will not be triggerable for another pull cycle until after a second time interval. This pull current lockout mechanism prevents inadvertent application of a second pull current pulse before the heat has dissipated from the previous pull current pulse.

Because there is no danger of additional current being applied to the pull coil before it has cooled, there is no need to construct this coil to withstand excessive current load.

These and other objects, features and advantages of the invention will become more apparent when the detailed description is studied in conjunction with the drawings, in which:

DETAILED DESCRIPTION OF PREFERRED EMBODIMENTS

Figure 1:
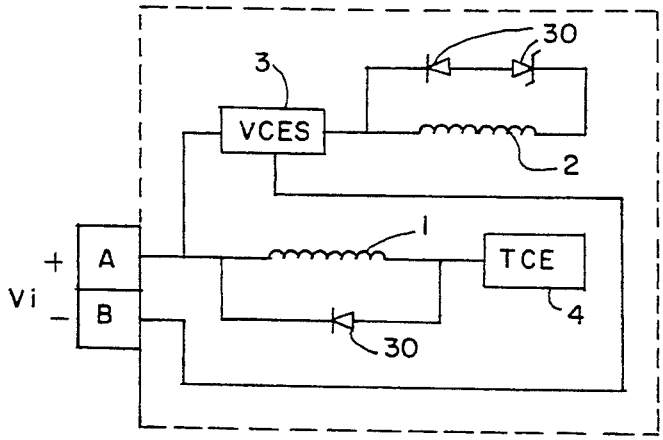
FIG. 1 is a diagrammatic representation of a solenoid with two coils and control circuit of the invention.

Referring now first to FIG. 1, a solenoid or other electromagnetic device has a pull coil 1 and a hold coil 2 that generate a magnetic flux to operate an armature 8. When an input voltage is applied at Vi, voltage is applied to the voltage controlled electronic switch 3 (VCES) in the hold coil circuit and to the time controlled electronic switch 4 (TCES) in the pull coil circuit, the VCES switch 3 applies current to the hold coil 2 only when the input voltage rises above a preset threshold. The switch remains closed until the input voltage falls below a preset dropout voltage. The switch 3 may be constructed to remain open until the input voltage drops to an adjustable level between zero and the dropout voltage, before it will again respond to a voltage above the threshold. The TCES switch 4 responds to an input voltage above a preset threshold value by applying current to the pull coil for a preset time interval, at which time the switch opens so that no more current will flow through the pull coil. This ensures that only a fixed amount of electrical energy will flow through the coil to enable the coil parameters to be optimized without providing a safety factor for inadvertent application of excessive current with burn out. To further ensure against overheating, the time controlled switch 4 provides a preset lockout time interval during which the switch will not respond to input voltage.

Figure 2:
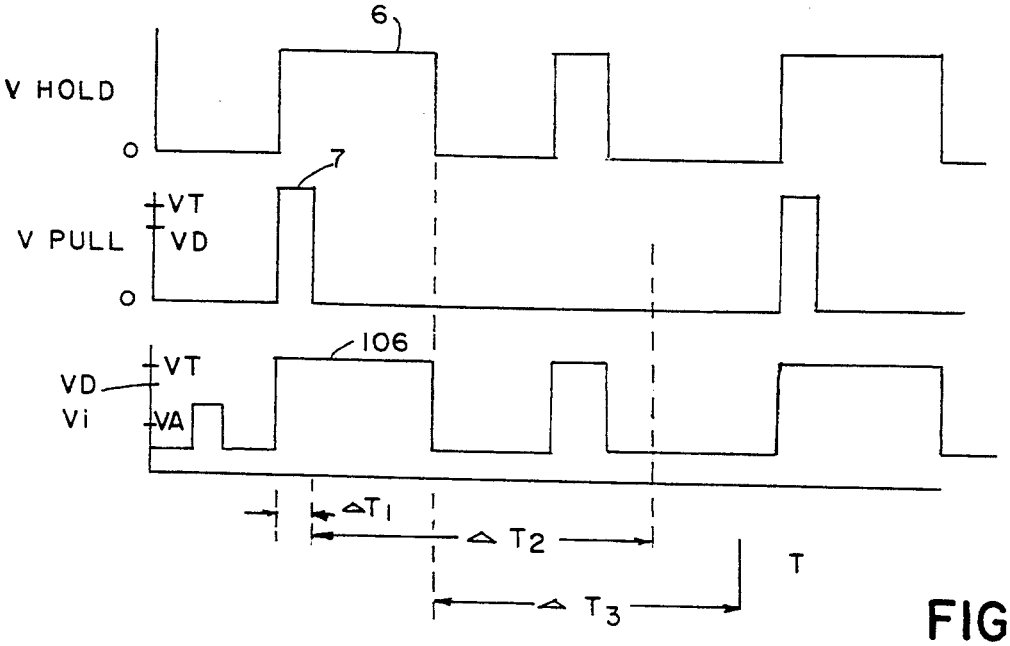
FIG. 2 is a graphical representation of the temporal relationships of various parameters of the control circuits of the invention.

Referring now to FIG. 2, the graph in FIG. 2 shows the voltages at the hold coil (V hold), the pull coil (V pull) and the input (Vi) all plotted against time T on the abscissa. It will be seen that when the input voltage Vi rises to a level 5 that is below the threshold voltage VT, nothing happens. When the input voltage rises above the threshold voltage VT as at 106, the VCES circuit causes voltage to be applied to the hold coil 2 as shown at 6. When input is above the preset voltage V3 of the TCES, which is generally set at the same level as VT, voltage is applied to the pull coil as at 7 for a preset time interval of $\Delta T1$, at which time the TCES is disabled for a preset time interval $\Delta T2$, during which voltage will not be applied to the pull coil. When the input voltage drops below the dropout voltage VD, the voltage to the hold coil is removed.

In an alternative embodiment, the time interval during which the TCES is disabled may begin when the hold voltage drops out as shown by ΔT3. Any of these time intervals and voltage levels may be fixed or adjustable as indicated by adjustor controls 13, 18, 20, 24 in FIG. 3.

Figure 3:
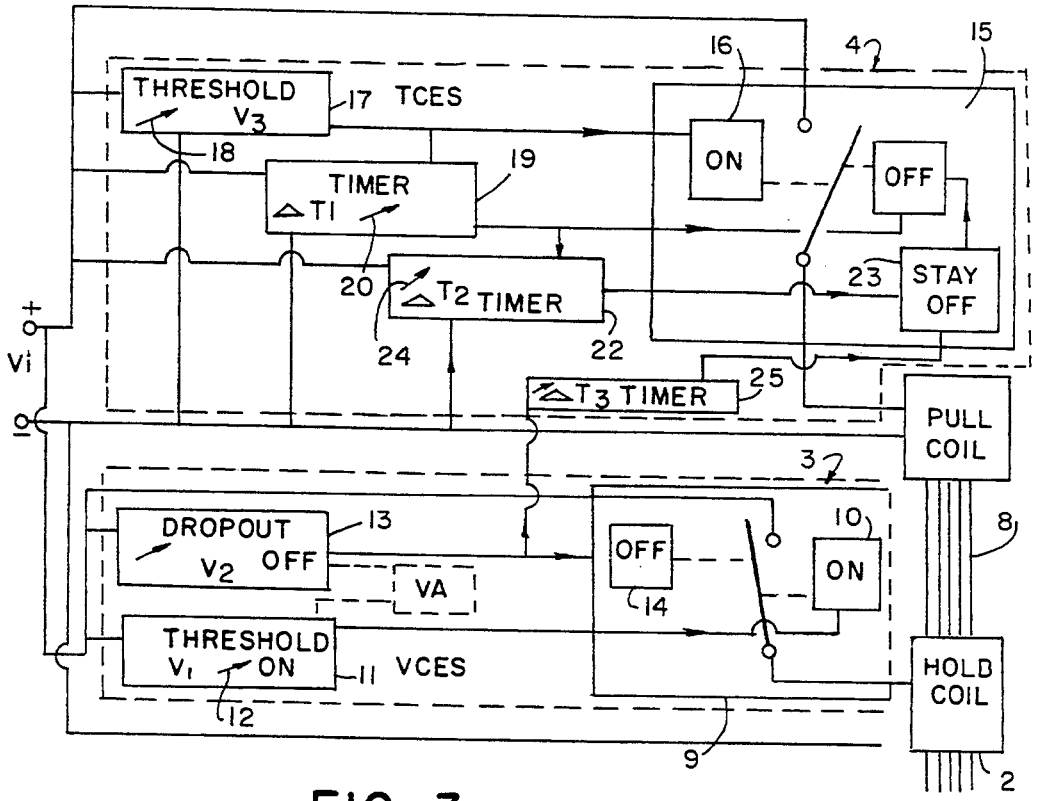
FIG. 3 is a diagrammatic representation of a two coil solenoid with control circuits of the invention shown in greater detail.

Referring now to FIG. 3, the hold coil 2 and pull coil 1 are shown around the common core or armature 8. Input voltage is applied at Vi and is conducted to TCES 4 and VCES 3. The voltage controlled, electronic switch assembly 3 has a switch element 9 for applying voltage to the hold coil 2 when closed by a signal applied to the ON element 10. A threshold or trigger circuit 11 applies a triggering signal to the ON element 10 whenever the input voltage exceeds the preset threshold voltage VT set by adjustment 12 to thereby actuate hold coil 2. Another trigger circuit, a dropout voltage circuit 13, sends a signal to the OFF element 14 on the VCES switch element whenever the input voltage falls below the preset dropout voltage level VD. Once the switch element 9 is pulled open, it will remain open until the ON element 10 is again actuated. Alternatively, the dropout circuit 13 may be arranged to prevent closing of switch element 9 until the input voltage drops to an adjustable level at VA (shown in phantom) between zero and the dropout voltage.

The time control, electronic switch assembly 4 has a switch element 15 for applying a pull-in voltage to the pull coil 1 when closed by a signal to the ON element 16. A threshold circuit 17 applies a signal to the ON element 16 whenever the input voltage exceeds the preset threshold voltage V3 set by adjustment 18. The signal that goes to the ON element to apply voltage to the pull coil also goes to first timer 19, which starts a preset time interval T1. The duration of the time interval may be adjusted by adjuster 20. When the time interval ΔT1 is completed, an off signal from timer 19 is passed to OFF element 21 which opens the switch element 15 and cuts off power to the pull coil. The off signal from the first timer 19 is also sent to the second timer 22 which starts preset time interval ΔT2 during which a signal from the second timer is applied to stay off element 23 which prevents the switch element 15 from closing during the time interval ΔT2. The duration of T2 may be adjusted by adjuster 24. This prevents the pull coil from receiving any more power before it has cooled.

Alternatively, the second timer 22 may be replaced by third timer 25 whose time interval ΔT3 is started by the time of drop out of the hold coil voltage. In certain circumstances, there may be only a single coil arranged with a control circuit consisting of the application of both hold and pull voltages to the single coil using certain or all of the same windings with the above disclosed control circuitry.

Figure 4:
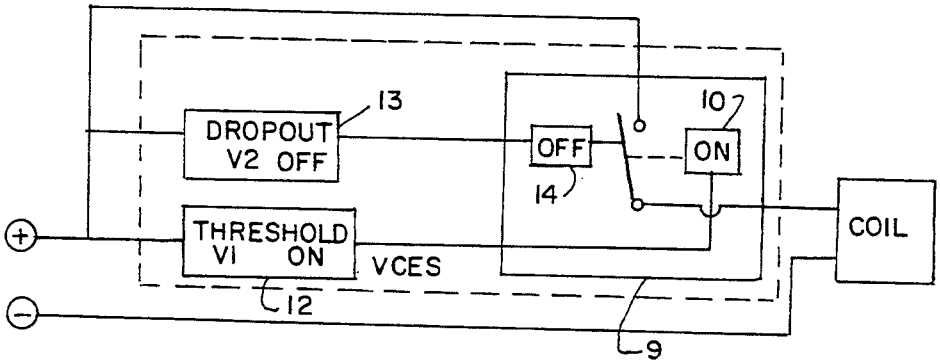
FIG. 4 is a diagrammatic representation of a single coil electromagnet with control of threshold and dropout voltages.

FIG. 4 shows a single coil embodiment of the invention with threshold control 12 and dropout control 13.

Figure 5:
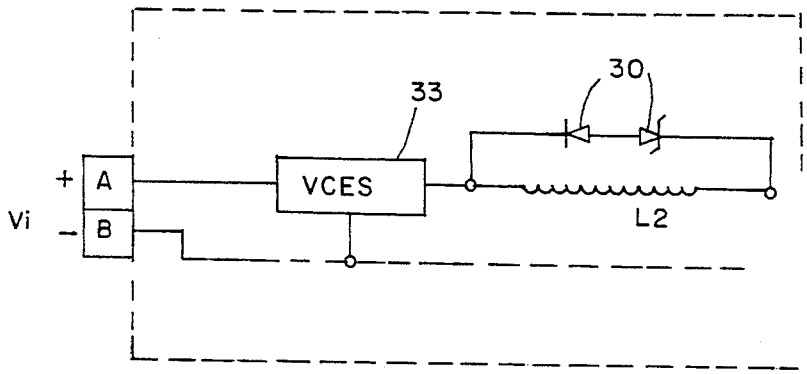
FIG. 5 is a diagrammatic representation of a single coil electromagnet with only a threshold voltage control electronic switch.

FIG. 5 shows a single coil embodiment of the invention with a voltage control electronic switch 33 responsive only to a threshold voltage.

Alternatively, a single coil device may be powered through a control circuit employing only the voltage control electronic switch 3 of the invention.

The diodes 30 of FIG. 1 may be provided for inductive spike voltage suppression. The specific electronic circuits that may be employed to perform the above disclosed control functions may be selected from any of the circuits and components well known in the art and need not, therefor, be herein disclosed in detail.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. A control system for an electromagnet for furnishing, in response to an initiating voltage of a particular amplitude and duration, a high initial pull flux followed by a smaller hold flux, while preventing overheating, the system comprising:

A. a first circuit means including a pull current source connection and a pull coil means for generating a pull flux;

B. a second circuit means including a hold current source connection and a hold coil means for generating a hold flux;

C. a first threshold means in said first circuit means for initiating a pull current in said pull coil means upon application of an initiating voltage that exceeds a first preset voltage level;

D. a first timing means in said first circuit means for discontinuing said pull current at the end of a first preset time interval;

E. a second timing means in said first circuit means for rendering said first circuit means unresponsive to an initiating voltage for a second preset time interval;

F. a second threshold means in said second circuit means for initiating a hold current in said hold coil means upon application of an initiating voltage that exceeds a second preset voltage level;

G. a third threshold means in said second circuit means for discontinuing said hold current when said initiating voltage falls below a third preset voltage level.

2. The system according to claim 1, in which at least one of said preset voltage and time levels is adjustable.

3. The system according to claim 1, in which said second preset time interval begins when said pull current is discontinued.

4. The system according to claim 1, in which said second preset time interval begins when said hold current is discontinued.

5. The system according to claim 1, in which said pull coil means and said hold coil means have at least some windings in common.

6. The system according to claim 1, in which said third threshold means, after discontinuing said hold current, renders said second threshold means unresponsive to initiating voltage until after said initiating voltage has first fallen to a level between said third preset voltage and zero.

7. The system according to claim 1, in which said third threshold means, after discontinuing said hold current, renders said second threshold means unresponsive to initiating voltage until after said initiating voltage has first fallen to a preset level adjustable between zero and the dropout level.

8. A control system for an electromagnet for furnishing, in response to an initiating voltage of a particular amplitude and duration, a discrete operating flux while preventing overheating, the system comprising:

A. a circuit means including a current source connection and a coil means for generating flux;

B. a first threshold means in said circuit means for initiating a current in said coil means when said initiating voltage exceeds a first preset voltage level;

C. a second threshold means in said circuit means for discontinuing said current when said initiating voltage falls below a second preset voltage level.

9. The system according to claim 8, in which at least one of said preset voltage levels is adjustable.

10. The system according to claim 8, in which said second threshold means, after discontinuing said current, renders said first threshold means unresponsive to initiating voltage until after said initiating voltage has first fallen to zero.

11. The system according to claim 7, further comprising a third threshold means in which said third threshold means, after discontinuing said hold current, renders said second threshold means unresponsive to initiating voltage until after said initiating voltage has first fallen to a preset level adjustable between zero and said second preset voltage level.

12. The system according to claim 7, further comprising a first timing means in said circuit means for discontinuing said current at the end of a preset time interval.

13. The system according to claim 12, further comprising a second timing means in said circuit means for rendering said circuit means unresponsive to said initiating voltage for a second preset time interval.

14. The system according to claim 13, in which said first and second time interval are adjustable.

15. The system according to claim 12, in which said first time interval is adjustable.

16. A control system for an electromagnet for furnishing, in response to an initiating voltage of a particular amplitude and duration, a high initial pull flux followed by a smaller hold flux, while preventing overheating, the system comprising:

A. a first circuit means including a pull current source connection and a pull coil means for generating a pull flux;

B. a second circuit means including a hold current source connection and a hold coil means for generating a hold flux;

C. a first threshold means in said first circuit means for initiating a pull current in said pull coil means upon application of an initiating voltage that exceeds a first preset voltage level;

D. a first timing means in said first circuit means for discontinuing said pull current at the end of a first preset time interval; and E. a second timing means in said first circuit means for rendering said first circuit means unresponsive to an initiating voltage for a second preset time interval.

17. The system according to claim 16, in which said first preset time interval is adjustable.

18. The system according to claim 16, in which said first and second time intervals are adjustable.

19. The system according to claim 16, in which said second time interval is adjustable.

* * * * *